US005653441A

United States Patent [19]

Woltanski

[11] Patent Number: 5,653,441

[45] Date of Patent: Aug. 5, 1997

[54] RACKET STRING COMB

[76] Inventor: Theodore M. Woltanski, 21091 Chubasco La., Huntington Beach, Calif. 92646

[21] Appl. No.: 700,804

[22] Filed: Aug. 21, 1996

[51] Int. Cl.[6] ..... A63B 49/00

[52] U.S. Cl. ..... 473/553

[58] Field of Search ..... 273/73 R, 73 A, 273/73 B, 73 D

[56] References Cited

U.S. PATENT DOCUMENTS

| | | | |
|---|---|---|---|
| 4,089,523 | 5/1978 | Newburger et al. | 273/73 R |
| 4,733,866 | 3/1988 | Herbert | 273/73 R |
| 4,752,071 | 6/1988 | Tabach | 273/73 R |
| 4,776,591 | 10/1988 | Ho | 273/73 R |
| 4,989,864 | 2/1991 | Ubl | 273/73 R X |
| 5,035,429 | 7/1991 | Redrow | 273/73 R |
| 5,207,423 | 5/1993 | Short | 273/73 R |
| 5,222,998 | 6/1993 | Ferrari et al. | 273/73 R X |
| 5,310,181 | 5/1994 | Chan | 273/73 R |
| 5,441,258 | 8/1995 | Pagan | 273/73 D |

FOREIGN PATENT DOCUMENTS

| | | | |
|---|---|---|---|
| 2661102 | 10/1991 | France | 273/73 D |
| 2280612 | 2/1995 | United Kingdom | 273/73 D |

*Primary Examiner*—William E. Stoll
*Attorney, Agent, or Firm*—Sandra M. Parker

[57] ABSTRACT

This invention relates to a racket string comb, to be used on the strings in the head of a tennis, racquetball, squash or badminton racket, that can be manually manipulated to move the strings back to their correct position. The improved tennis racket string straightener is a one-piece pocket comb, preferably of molded plastic, which consists of a comb body and integrally placed, widely spaced, narrow claws depending therefrom, along the width thereof. The claws in the preferred embodiment are all of the same size and spacing. The comb body has a handle extended from the comb body at a generally fortyfive degree angle, rounded at the bottom to provide finger comfort and prevent pocket snagging.

20 Claims, 1 Drawing Sheet

RACKET STRING COMB

BACKGROUND OF THE INVENTION

1. Field of the Invention

This invention generally relates to the field of hand-held devices useful for respacing the racket strings of tennis, racquetball, squash or badminton rackets. The present invention is particularly directed towards a portable hand-held tool to be used off and on courts, during breaks in play, to realign the vertical and horizontal positions of racket strings which have moved during the game.

2. Brief Description of the Prior Art

A tennis racket principally consists of a head, a throat and a handle. The head includes a set of horizontal and vertical strings and a frame, wherein the frame is used for supporting the set of strings. The strings are interlaced in a spaced-apart 90-degrees crossing pattern. The shape of the frame and the vertical and horizontal spacing of the tennis strings determines the position of the "sweet spot", a hitting area in the center of the racket head, of that particular design of the racket.

When the racket is initially strung, the tension of the strings is carefully controlled in accordance with the skill and preference of a player. Normally, the vertical and horizontal strings are stretched to a tension of between 55 and 70 pounds, but some players prefer a lighter tension, as low as 40 pounds. No matter how low or how high the tension is set in the stringing process, during play the crossing pattern of the strings gets frequently disturbed. When this happens, one or more strings near the center of the head area are moved away from their usual 90-degrees crossing pattern.

When a string is stretched to a moved position, away from its original position, it becomes elongated. With the change in strings elongation, the original tension of the strings in the racket is modified. This modifies the hitting properties of the racket and consciously or unconsciously affects the player's control of the ball. As the ball leaves the surface of the racket, the direction and velocity of the traveling ball in its path of travel is changed.

During each play, the impact of the ball upon the strings when a shot is made often distorts the strings from their original spacing. The degree of distortion is a result of the speed of the ball, when making contact with the racket string, and the angle of the racket at which the player strikes the ball. The distortion repositions the area of the "sweet spot" and makes the player loose confidence in his shot. In addition, strings can come out of alignment with each other after only a few strokes of the tennis racket in play, due to modern high velocity hits and techniques where the tennis ball is not struck flush but instead is struck at an angle in order to import substantial ball spin or for angular direction.

It has been recognized that it is desirable to keep the strings of a racket in proper alignment with each other during play in order to provide optimal racket efficiency and string durability. Therefore, it is desirable to control the position of the individual strings in the crossing string pattern as closely as possible and to keep their original positions at all times, in order to maintain the designed tension in the hitting area in the head of the racket.

There is a need for a simple, portable tool enabling players to return the horizontal and vertical racket strings to the original "sweet spot", in order to ensure consistency of ball direction and force and accuracy of shots. Further, this will reduce tendency of the strings to take a permanent set and lose their tension due to stretching, if they are left in a distorted position for long periods of time, and to reduce the time between restringing the racket, due to the stretching of the strings and softening of their original tension, from the time when they were first installed or restrung.

Large, complex, bulky and expensive string straighteners have been available for a while, and are kept on the court sidelines. However, although helpful, these advances in the design are inflexible and unable to cover players' needs occurring during game. In most instances, when strings become misaligned, the player must resort to finger tuning the racket, by manually moving the strings to their approximately proper positions from time to time, when he or she has completed their active playing session.

Lately however, portable realigning tools are becoming popular, due to ever increasing demand for repositioning of racket strings during game. These portable devices presently utilized range from simple to very complex. For example, U.S. Pat. No. 4,752,071 issued in 1988 to Tobach discloses a simple portable hook which is used to straighten only one string opening at a time. Its use takes considerable time if, as is usually the case, a number of strings are out of alignment.

U.S. Pat. No. 4,489,942, Kent, granted in 1984, discloses a device for aligning strings in the grid of a tennis racquet. The device is comprised of a base which has a peripheral groove for receiving the frame of the racquet. The base has a plurality of posts arranged and shaped to intersect the spaces between strings. A tooth is hinged to the base and acts as a press to force the tennis racquet down on the posts, causing mislocated strings to become aligned.

Redrow U.S. Pat. No. 5,035,429 from 1991 for String Straightener For Tennis Racket describes a straightener that automatically adjusts itself to the model of the racket. The device has a plurality of flexible, narrow, tight-knitted teeth with V-shaped edge. The teeth are flexible and two or more teeth can fit in the same space between the strings.

Short U.S. Pat. No. 5,207,423 from 1993 for Tennis Racket String Straightener relates to a tool with triangular, wide teeth that are either placed apart by the same distance or with gradually increasing distance.

Herbert U.S. Pat. No. 4,733,866 from 1988 depicts a Portable String Aligner For Rackets. Their tool has replaceable, variously sized pegs with pyramidal, bullet, or bevelled ends.

Chan U.S. Pat. No. 5,310,181 from 1994 describes a Racquet String Aligner. This invention is described as placed on a ball container cap. The pegs are pyramidal and placed in two-dimensional rows and columns.

Ho U.S. Pat. No. 4,776,591, describes a comb-like aligner with unconnected teeth and with a string receiving notch. The teeth are pyramidal.

Macknigg U.S. Pat. No. 5,310,182 from 1994 describes a string adjuster with one or more rollers rotatingly moving the strings in a very fast fashion.

The U.S. Pat. No. 4,089,523 to Newburger et al. shows a plate having fixed teeth of a pyramidal shape, adapted to move strings back into their original positions when pressed into the openings in the crossing pattern.

Some simple devices, mentioned above, may be adequate, assuming that the spaces between the strings and their shapes are all of a standard pattern. However, many of the tennis rackets in use today are strung with different crossing string patterns, using differently spaced strings, and there seems to be no standard for shapes or sizes of spacings between the horizontal and vertical strings in many of the modern rackets.

Therefore, several patents mentioned earlier, like the U.S. Pat. Nos. 4,733,866 to Herbert and 4,776,591 to Ho, show string straightening means for use on different tennis rackets, that may have strings spaced apart in different patterns. In each of these respective patents, adjustably mounted string engaging pegs or teeth are described, which must be adjusted to fit the particular string arrangement of each racket upon which the respective device is to be used. After the location of pegs or teeth has been chosen and they have been individually moved to a proper setting, they are locked in place for cooperating with the strings.

The existing racket string straightener devices require a great deal of time and patience to return the strings to their proper place, because these devices must be readjusted several times to cover the strings across the entire face of the racket.

SUMMARY OF TEE INVENTION

Accordingly, the present invention satisfies a need for a portable, simple, small, hand-held, light weight, pocket-size string straightener, without moving parts, which can quickly, easily and properly realign a number of racket strings during the time when a player is walking to the next position on the court and preparing for the next point.

The present invention is capable of providing an inexpensive, easy to manufacture and convenient tool for use on racket strings of varying sizes.

Another advantage of the racket string comb developed in the present invention is that the additional and complicated extraneous rollers and pegs, described by prior art, are not needed.

Yet another advantage of this racket string comb is that it can be used on different rackets, that may have strings spaced apart in different patterns, without any adjustment. Moreover, it can be made in different sizes to accommodate different string patterns for respacing the racket strings of tennis, racquetball, squash or badminton rackets.

The preferred embodiment of the present invention is a string adjuster for aligning the strings of a racket having a comb body, with a top end and a bottom end, a front surface and a back surface thereof, a plurality of claws and a comb handle. The comb handle is rounded at its end and integrally placed at the comb body bottom end and joined to the comb body bottom end at an angular junction having a predetermined angle.

The claws are generally narrow and generally L-shaped, and made integral with the comb body and depending from the top end of the comb body at a generally right angle. Each claw has the same size and the claws are spaced apart at even spacing. The claws have a claw pushing surface, a claw pulling surface and a claw tip, wherein the claw pushing surface and the claw tip are generally rectangular in side, top and front elevation and joining at a predetermined angle and the claw tip has a predetermined downward orientation.

Each claw further has a first rounded junction, between the pulling surface and the comb body, and a second rounded junction, between the claw pulling surface and the claw tip, to prevent racket string damage.

DESCRIPTION OF THE DRAWINGS

The features of the present invention can be best understood together with further objectives and advantages by reference to the following description, taken in connection with the accompanying drawings, wherein like numerals indicate like parts.

DESCRIPTION OF THE INVENTION

In the following description, numerous specific details are set forth in order to provide a more thorough description of the invention. It will be apparent, however, that the present invention may be practiced without these specific details. In other instances, well known features have not been described in detail so as not to unnecessarily obscure the present invention.

This invention relates to a racket string comb device having several fixed, spaced apart claws, usable to engage and realign the misaligned racket strings through manipulation of the comb's handle. This can be done after each match, between the sets and even between shots, in order to provide for better game and less frequent costly restringing.

Figure 1:
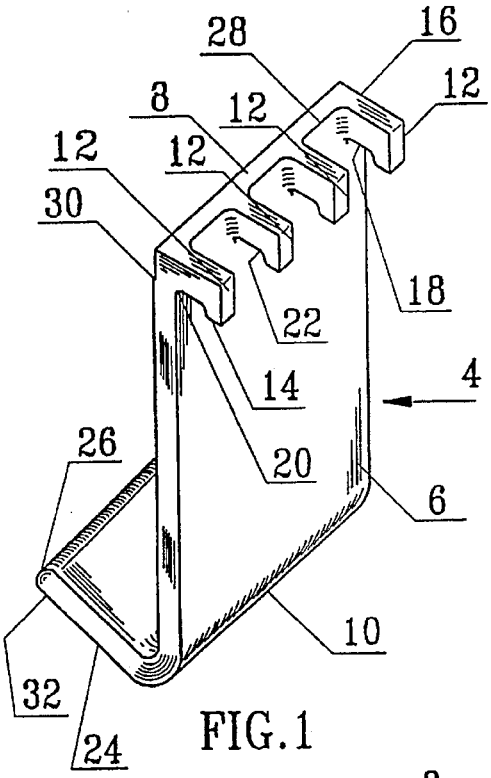
FIG. 1 is a perspective view of a racket string comb, in accordance with the preferred embodiment of the present invention.

In accordance with the preferred embodiment of the present invention, a perspective view of a one-piece portable racket string comb 4 is presented in FIG. 1. The comb 4 has a comb body 6 of small dimensions, which may vary depending on the racket size, and a plurality of claws 12, depending from a comb body top 8 at a generally right angle, made integrally with the comb body 6 and placed along the width thereof. The claws 12 in the preferred embodiment are all the same size and placed at an equal spacing 28, and there are four comb claws 12, but there can be more or less claws 12, preferably from three to six. The length and the width of the claws 12 may vary. The width of the claws 12 and the spacing 28 between the claws 12 is sufficient to accommodate at least one and maximum two said claws 12 to fit simultaneously inside a space between two racket strings. The comb body 6 is preferably a flat rectangular surface, having a width to extend about quarter way across the width of a racket. After insertion of the claws 12 between the racket strings, the comb 4 lays flat against the racket strings.

Figure 2:
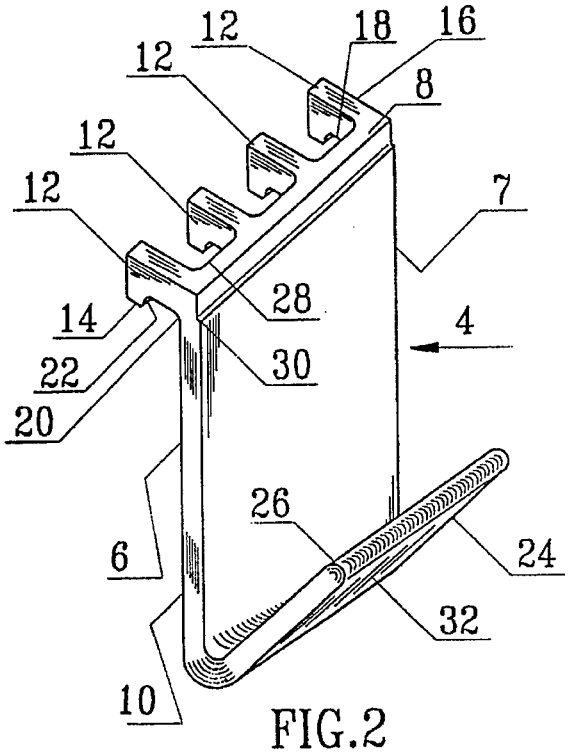
FIG. 2 is another perspective view of the racket string comb, in accordance with the preferred embodiment of the present invention.

In FIG. 2, another perspective view of the preferred embodiment is presented, in order to show an alignment recess 30, placed on a back comb surface 7, at the back of the comb body 6, and facing the user after the claws 12 are inserted during use. The alignment recess 30 guides the user in aligning the misaligned racket string with the corresponding holes, drilled in each side of the racket to hold the racket string. The alignment recess 30 is preferably formed by indenting the back comb surface 7 of the comb body 6, above the alignment recess 30.

Additionally, at a comb body bottom 10, placed at the bottom of the comb body 6, there is a comb handle 24 made integrally with the comb body 6 and used to easily manipulate the comb 4. The comb handle 24 is rounded at its end 26 to provide finger comfort when pulling down on the racket string engaged by a claw pulling surface 18, and to prevent pocket snagging. The comb body bottom 10 is joined to the comb handle 24 at an angle, which is preferably a 45 degrees angle, and this connection is rounded to prevent catching the strings when the comb 4 is pulled down.

Figure 3:
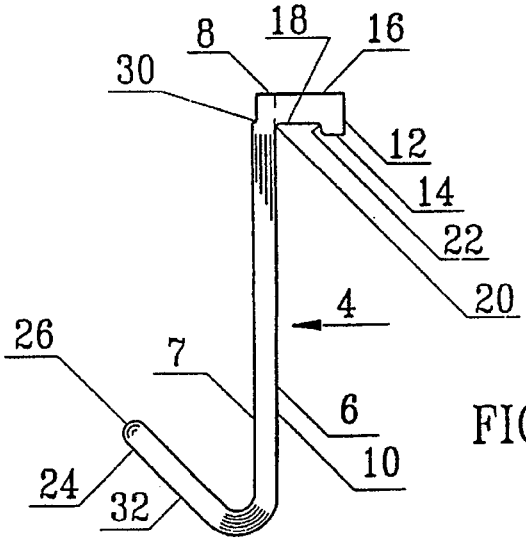
FIG. 3 is a side view of the racket string comb, in accordance with the preferred embodiment of the present invention.

The comb handle 24 is generally long to allow easy grip for younger or older players. In addition, this type of handle 24 prevents fingernail breaking, especially for players with long fingernails, and prevents finger hurting. Further, the handle 24 gives the player more power, and faster and more accurate shots. The shape of the comb handle 24 and the claws 12 can be seen in another, side view of the preferred embodiment, shown in FIG. 3.

In the preferred embodiment, each said claw 12 is generally L-shaped and has a claw tip 14 thereof pointing down to prevent strings from disengaging and slipping off the comb 4, when the comb 4 is pulled down. The claw tip 14, a claw pushing surface 16 and the claw pulling surface 18 are generally rectangular in side, top and front elevation. The claw tip 14 is joining the claw pushing surface 16 at a predetermined angle, preferably at a right angle. Each said claw 12 has a claw rounded surface 20 between the claw pulling surface 18 and the comb body 6, and a claw rounded surface 22 between the claw pulling surface 18 and the claw tip 14. The comb claw tips 14, as well as the claw rounded surfaces 20 and 22, are slightly rounded to prevent tennis racket string damage during string pulling, and damage to a pocket, in which comb 4 can be carried when not in use. In addition, the top surface of the comb claw 12, which is the claw pushing surface 16, is used to push up the strings, and the claw 12 bottom surface is the claw pulling surface 18, used to pull down the string.

The racket string comb 4 is used by working one string at a time, preferably starting with the vertical strings and at the bottom of the racket. The racket is turned so that the vertical strings are positioned horizontally and the comb 4 is initially aligned horizontally with one of the strings, using the alignment recess 30 as a guide to position the comb 4 parallel with the chosen string.

The comb claws 12 are gently inserted in a racket string space at the racket along a horizontal line. The comb 4 is then urged forward until the racket string gets in touch with the rounded surfaces 20, and the comb pulling surfaces 18 are used to pull the string down into proper alignment, by pulling down on the handle 24 with two or three fingertips, at the handle end 26. The racket string comb 4 is then withdrawn and quickly reinserted at another corresponding horizontal location along the same string or, if that string is aligned, above or below the string, if needed. The same procedure should be repeated for all misaligned horizontal strings.

It will be understood that the above description assumes that the racket will be held vertically and that the comb claws 12 will be inserted in a horizontal plane to straighten the horizontally held strings. However, the relative orientation of the comb 4 and the racket will be the same, whether the racket is held vertically or horizontally during straightening, since the comb 4 is always used in a position generally perpendicular to the main plane of the racket and transverse of the racket.

The same procedure should be repeated on misaligned horizontal strings. Usually, insertions at two or three such locations at each direction are adequate to fully straighten the racket strings. This can be done within a few seconds as the player walks to the next position between points during play, without interrupting the game. The comb 4 can then be placed in a pocket until needed to be reused, usually after every three or four points.

If a string gets pulled too far down, the claws 12 of the racket string comb 4 are inserted below the string and then gently pushed upwards against the string with the claw pushing surfaces 16, by pushing a thumb against an outside handle surface 32, in order to strengthen the misaligned string.

Preferably, the comb 4 is of fully unitary construction and is made to be stiff and strong. In order to assure the formation and maintenance of critical dimensions for claw 12 it is preferred that no component thereof be thicker than ¼ inch. Each comb claw 12 may be, for example, about ⅛ to 3/16 inches wide, about 5/16 inch long and about ¼ inch deep and the claws 12 are placed wide-apart by the same spacing 28, preferably ⅜ inch wide, although the claws 12 can have any other dimension and spacing.

The racket string comb 4 can be machined from a metal material such as aluminum, or using aluminum injection molding in a single or multiple cavity mold, and then anodized. Preferably, however, the comb 4 is made of plastic material, like a polyvinyl chloride or other suitable resin in an injection molding machine, utilizing a single or multiple cavity mold, or whittling the tool from a piece of wood stock. The alignment recess 30 is preferably molded into the back comb surface 7, although it could also be made by silk screening on a clear plastic comb 4, or substituted with a rib and molded with the comb 4.

Accordingly, the comb 4 can be made relatively small, portable, inexpensive, compact, light in weight, durable and efficient for its intended use. With the racket string comb 4 no adjustment is needed to fit the particular string arrangement of each racket upon which the comb 4 is to be used. Due to the narrowness of the claws 12 and the wide distance between the claws 12, the racket string comb 4 can be used on different rackets, that may have strings spaced apart in different patterns, without any adjustment. Moreover, if necessary, it can be made in different sizes to accommodate different string patterns for realigning the strings of tennis, racquetball, squash or badminton rackets.

While the proffered embodiments have been described and illustrated, various modifications and substitutions may be made hereto without departing from the scope of the invention. Accordingly, it should be understood that the present invention has been described by way of illustration and not limitation.

What is claimed is:

1. String adjuster for aligning the strings of a racket comprising:

a comb body having two ends on opposite sides thereof, a top end and a bottom end, and a front surface and a back surface thereof;

a plurality of claws made integrally with said comb body and depending from said top end of the comb body at a generally right angle; and a comb handle wherein said comb handle is integrally placed at the comb body bottom end and joined to the comb body bottom end at an angular junction having a predetermined non-zero angle.

2. The string adjuster according to claim 1 wherein each said claw is generally narrow and generally L-shaped, each said claw having the same size and wherein said claws are spaced apart at even spacing.

3. The string adjuster according to claim 1 wherein each said claw further having a claw pushing surface, a claw pulling surface and a claw tip, wherein said claw pushing surface and said claw tip are generally rectangular in side, top and front elevation and joining at a predetermined angle, and said claw tip having a predetermined downward orientation.

4. The string adjuster according to claim 3 wherein each said claw further having a first rounded junction, between said pulling surface and said comb body, and a second rounded junction, between said claw pulling surface and said claw tip, whereby to prevent racket string damage.

5. The string adjuster according to claim 1 further comprising an alignment indicating means placed on the comb body back surface whereby to show when the string has been moved to a straight line position.

6. The string adjuster according to claim 1 wherein said plurality of claws including generally 3 to 6 claws.

7. The string adjuster according to claim 1 wherein the comb handle is generally long to allow easy grip and is rounded at its end and wherein said angular junction is generally a 45 degree angle and wherein the angular junction is rounded for finger comfort.

8. The string adjuster according to claim 1 wherein the width of said claws and the spacing between said claws being sufficient to accommodate at least one and maximum two claws to fit simultaneously inside a space between two racket strings.

9. The string adjuster according to claim 1 wherein said claws and the spacing distances between them are sized for use with the strung heads of tennis, racquetball, squash and badminton rackets.

10. The string adjuster according to claim 1 wherein said comb body is in a form of a flat rectangular surface and having a width to extend about quarter way across the width of the racket.

11. String adjuster for aligning the strings of a racket comprising:

a comb body having two ends on opposite sides thereof, a top end and a bottom end, and a front surface and a back surface thereof;

a plurality of claws, wherein said claws are generally narrow and generally L-shaped, made integrally with said comb body and depending from said top end of the comb body at a generally right angle, each said claw having the same size and wherein said claws are spaced apart at even spacing;

wherein said claws having a claw pushing surface, a claw pulling surface and a claw tip, wherein said claw pushing surface and said claw tip are generally rectangular in side, top and front elevation and joining at a predetermined angle and said claw tip having a predetermined downward orientation; and a comb handle wherein said comb handle is rounded at its end and integrally placed at the comb body bottom end and joined to the comb body bottom end at an angular junction having a predetermined non-zero angle, wherein the angular junction is rounded for finger comfort.

12. The string adjuster according to claim 11 wherein each said claw further having a first rounded junction, between said pulling surface and said comb body, and a second rounded junction, between said claw pulling surface and said claw tip, whereby to prevent racket string damage.

13. The string adjuster according to claim 11 further comprising an alignment indicating means placed on the comb body back surface whereby to show when the string has been moved to a straight line position.

14. The string adjuster according to claim 11 wherein said plurality of claws including generally 3 to 6 claws.

15. The string adjuster according to claim 11 wherein the width of said claws and the spacing between said claws being sufficient to accommodate at least one and maximum two claws to fit simultaneously inside a space between two racket strings.

16. The string adjuster according to claim 11 wherein said comb body is in a form of a flat rectangular surface and having a width to extend about quarter way across the width of the racket.

17. String adjuster for aligning the strings of a racket comprising:

a comb body having two ends on opposite sides thereof, a top end and a bottom end, and a front surface and a back surface thereof;

a plurality of claws, wherein said claws are generally narrow and generally L-shaped, made integrally with said comb body and depending from said top end of the comb body at a generally right angle, each said claw having the same size and wherein said claws are spaced apart at even spacing;

wherein said claws having a claw pushing surface, a claw pulling surface and a claw tip, wherein said claw pushing surface and said claw tip are generally rectangular in side, top and front elevation and joining at a predetermined angle and said claw tip having a predetermined downward orientation;

wherein each said claw further having a first rounded junction, between said pulling surface and said comb body, and a second rounded junction, between said claw pulling surface and said claw tip, whereby to prevent racket string damage; and a comb handle wherein said comb handle is rounded at its end and integrally placed at the comb body bottom end and joined to the comb body bottom end at an angular junction having a predetermined angle, wherein the non-zero angular junction is rounded for finger comfort.

18. The string adjuster according to claim 17 further comprising an alignment indicating means placed on the comb body back surface whereby to show when the string has been moved to a straight line position.

19. The string adjuster according to claim 17 wherein said plurality of claws including generally 3 to 6 claws and wherein the width of said claws and the spacing between said claws being sufficient to accommodate at least one and maximum two claws to fit simultaneously inside a space between two racket strings.

20. The string adjuster according to claim 17 wherein said comb body is in a form of a flat rectangular surface and having a width to extend about quarter way across the width of the racket.

* * * * *